US006072399A

United States Patent [19]

Cimbal et al.

[11] Patent Number: 6,072,399

[45] Date of Patent: Jun. 6, 2000

[54] METHOD OF DETERMINING THE QUANTITY OF THE MATERIAL CUT BY AN ELECTRICALLY POWERED CUTTING TOOL AND CIRCUIT ARRANGEMENT FOR IMPLEMENTING THIS METHOD

[75] Inventors: Jochen Cimbal, Friedberg; Günther Bergk, Niedernhausen, both of Germany

[73] Assignee: Braun Aktiengesellschaft, Frankfurt Am Main, Germany

[21] Appl. No.: 09/130,163

[22] Filed: Aug. 6, 1998

[30] Foreign Application Priority Data

Oct. 4, 1997 [DE] Germany ..... 197 43 853

[51] Int. Cl.[7] ..... G08B 21/00

[52] U.S. Cl. ..... 340/635; 340/661; 340/664; 30/45

[58] Field of Search ..... 340/635, 648, 340/660, 661, 662, 663, 664; 30/45; 318/565, 566, 490

[56] References Cited

U.S. PATENT DOCUMENTS

| | | | |
|---|---|---|---|
| 3,846,688 | 11/1974 | Perloff | 318/490 |
| 4,075,792 | 2/1978 | Schreiber | 51/165.92 |
| 4,158,284 | 6/1979 | Wehde | 57/265 |
| 4,242,860 | 1/1981 | Wehde et al. | 57/81 |
| 5,111,580 | 5/1992 | Bosscha et al. | 30/41.7 |
| 5,274,735 | 12/1993 | Okada | 388/815 |
| 5,600,888 | 2/1997 | Becker | 30/41.7 |

FOREIGN PATENT DOCUMENTS

| | | |
|---|---|---|
| 196 06 719 A 1 | 8/1997 | Germany . |
| 02241480 | 9/1990 | Japan . |

OTHER PUBLICATIONS

International Search Report dated Jul. 22, 1999.

*Primary Examiner*—Daniel J. Wu
*Attorney, Agent, or Firm*—Fish & Richardson P.C.

[57] ABSTRACT

The invention is directed to a method and a circuit arrangement for determining the quantity of the material cut by an electrically powered cutting tool. According to the present invention, the fluctuations of the current consumed by a drive motor are detected, filtered and evaluated. By a comparison with a reference value, it is possible to determine the soiling of the cutting tool with cut residues. The invention is particularly suitable for use in shaving apparatus.

16 Claims, 1 Drawing Sheet

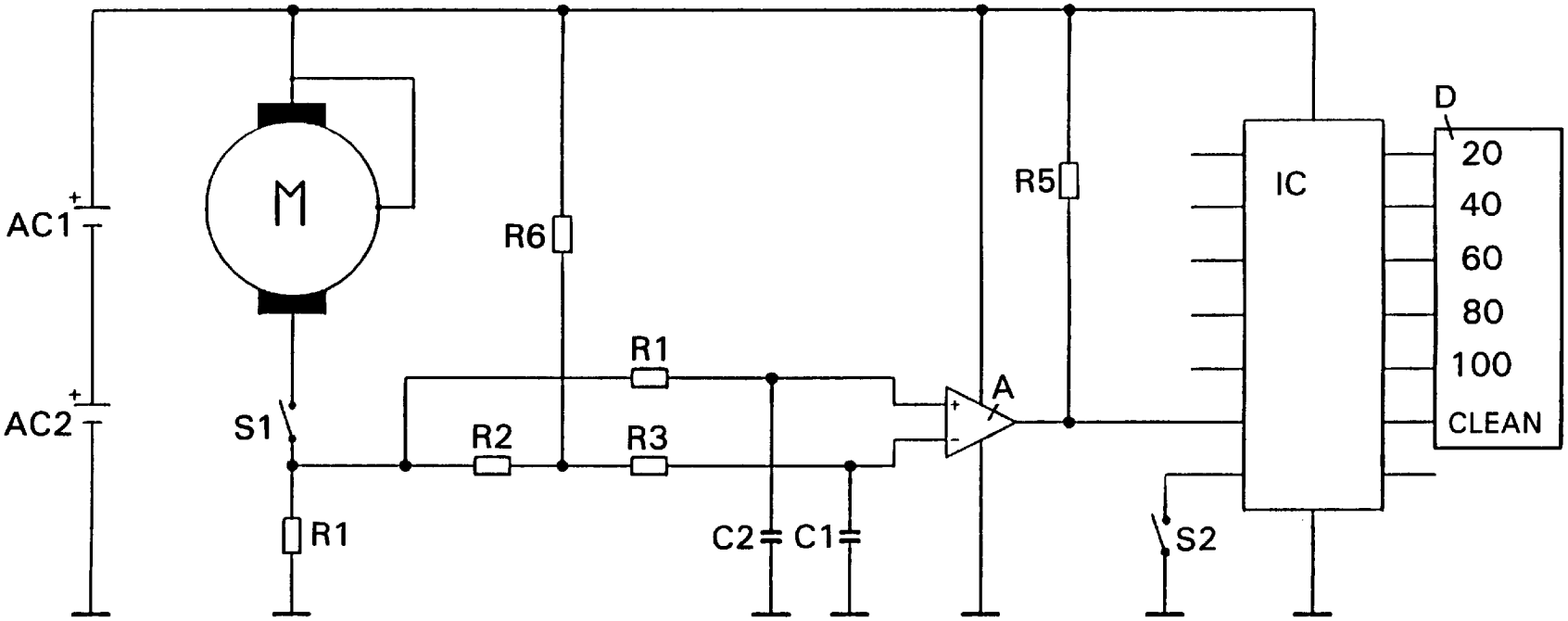
FIGURE

METHOD OF DETERMINING THE QUANTITY OF THE MATERIAL CUT BY AN ELECTRICALLY POWERED CUTTING TOOL AND CIRCUIT ARRANGEMENT FOR IMPLEMENTING THIS METHOD

FIELD OF THE INVENTION

This invention relates to a method of determining the quantity of the material cut by an electrically powered cutting tool and a circuit arrangement for implementing this method. The method of the present invention is suited for use with cutting tools that cut the material in a plurality of individual cutting operations, being intended particularly for such tools whose function is adversely affected by the cut material after a certain operating time has elapsed. This method finds preferred application, for example, in the measurement and indication of the degree of soiling of an electrically powered shaving apparatus, beard trimmer or the like.

DESCRIPTION OF THE PRIOR ART

From U.S. Pat. No. 5,111,580 it is known to count the number of shaves as yardstick for the soiling of a shaving apparatus. Further a method is known in the art in which the need to clean a shaving apparatus is indicated as a function of the elapsed operating time. Considering that varying amounts of shaving dust accumulate in the shaving head during a predetermined period of time or after a predetermined number of shaves, depending on the intensity of beard growth, etc. and the individual user's shaving habits, the instant of the time when a cleaning operation in necessary can be indicated with such methods only relatively inaccurately.

Still further, it is known from JP-A-02-241480 to measure the quantity of accumulated shaving dust in the shaving head by means of a light barrier and to provide an indication of the need for cleaning after a threshold value is exceeded.

From DE-A-19606719 a method is known in which the soiling is determined by evaluating the noises produced by at least one movable inner cutter or outer cutter of a shaving head of a shaving apparatus, the user being alerted to the need for cleaning at the appropriate moment.

A shaving apparatus in which the degree of soiling is determined according to either one of the last-mentioned methods necessarily accommodates suitable measuring devices in the shaving head. This entails a significantly increased design effort compared to a shaving apparatus without soiling indication.

SUMMARY OF THE INVENTION

It is therefore an object of the present invention to provide a method for determining the quantity of the material cut by an electrically powered cutting tool, which can be implemented without interfering with the design of the cutting tool and enables the quantity to be measured with precise accuracy. It is particularly an object of the present invention to provide a method for determining and indicating the degree of soiling of an electrically powered cutting tool. It is a still further object of the present invention to provide a circuit arrangement for implementing the method of the present invention.

The method of the present invention is based on the realization that the power consumption of an electrically powered cutting tool is subject to fluctuations caused by varying loads of the cutting tool as the material is being cut.

According to the present invention, these fluctuations in power consumed by the drive motor of the cutting tool, which are attributable to the individual cutting operations, are evaluated and used as a measure of the quantity of the cut material.

Because in a shaving apparatus, for example, the cut hairs accumulate in the interior of the shaving head and may eventually impair the function of the apparatus, it needs to be cleaned from time to time. Therefore, in accordance with a further aspect of the present invention, an indicating device is activated informing the user of the need for cleaning when the quantity of the cut material has reached a predetermined reference value.

An embodiment of the present invention will be explained in the following with reference to a shaving apparatus. It will be understood, however, that the invention may also find a useful application in other cutting tools, particularly of the type requiring residues of the cut material to be removed from time to time.

The first step of the method of the present invention comprises detecting the fluctuations of current consumed by the drive motor of the shaving apparatus, that is, generating a corresponding measuring signal. This is accomplished by means of a detecting element as, for example, a resistor connected in the motor circuit, where voltage fluctuations proportional to the current fluctuations are picked up. It will be appreciated that the current fluctuations may be also detected by inductive or other components.

The second step of the method of the present invention comprises filtering the measuring signal. In this step, from the fluctuations detected all those are filtered whose frequency is outside a specific frequency range. This may be performed by a low-pass filter, for example, which suppresses higher frequency interference pulses originating from the motor. Moreover, it is necessary to suppress low frequency fluctuations of the motor current caused, for instance, by a fluctuating operating voltage. In addition, preferably only such fluctuations are taken into account whose amplitude exceeds a predeterminable threshold value. In this manner, the measuring signal yields only pulses that are characteristic of the cutting operation.

The third step of the method of the present invention includes evaluating the pulses. In the two simplest cases, this takes place by counting the number of pulses or performing a total of the length of the pulses. A more accurate method is to integrate the pulses.

The fourth step of the method of the present invention comprises comparing the counter reading, the cumulative length or the integrated area of pulses with a reference value which corresponds to a predetermined quantity of the cut material. When this reference value is reached or exceeded, this will be indicated. The indication may use visual, audible or other means in a manner known in the art.

Where necessary, intermediate steps are inserted, as for example an amplification of the measuring signal and/or the pulses.

BRIEF DESCRIPTION OF THE DRAWINGS

A circuit arrangement for implementing the method of the present invention is illustrated in the accompanying drawing. This circuit arrangement is generally suited for the evaluation of current fluctuations and therefore not limited for use with cutting tools only. Further embodiments are explained in the description.

As shown in the sole FIGURE, the circuit arrangement of the present invention comprises a detecting element, a filter circuit, an evaluation circuit, and an indicating device.

DESCRIPTION OF THE PREFERRED EMBODIMENTS

The detecting element comprises a measuring resistor R1 connected in the circuit of a direct-current motor M which can be turned on and off by a switch S1 and is supplied with power from a two-cell storage battery AC1, AC2. The measuring resistor is part of a voltage divider comprised of three resistors R1, R2, R6 to which the voltage of the storage battery is applied. The storage battery also serves to supply power to the filter circuit, the evaluation circuit and the indicating device. Other embodiments may use a battery or a power pack as power supply.

The filter circuit is comprised of an active band-pass filter including a first low-pass filter R3/C1 with a first cut-off frequency and a second low-pass filter R4/C2 with a second cut-off frequency as well as an operational amplifier A. The second low-pass filter R4/C2 is connected between the junction of the measuring resistor R1 and the succeeding resistor R2 of the voltage divider, and the non-inverting input of the operational amplifier A, while the first low-pass filter R3/C1 is connected between the junction of the succeeding resistor R2 and the third resistor R6 of the voltage divider, and the inverting input of the operational amplifier A. The output of the operational amplifier A is connected to the evaluation circuit IC and, via a resistor R5, to the positive terminal of the storage battery.

The evaluation circuit comprises a microcontroller IC having the indicating device D connected thereto. This device possesses several segments which can be selected individually by the microcontroller IC to indicate the degree of soiling of the shaving head and the level of charge of the storage battery. In the example illustrated in the FIGURE, the charge is indicated in 20% increments. It will be understood, of course, that the soiling indication may also be provided by a light-emitting diode, an electroacoustic transducer or the like. The micro-controller IC is connected to a device enabling the counter reading and hence the soiling indication to be reset to zero. This device may be a switch S2, for example, which is disposed on the shaving head in a manner known in the art, so that the reset function is performed automatically on removal of the shaving head.

The first low-pass filter R3/C1 serves the function of suppressing interference signals caused particularly by the commutator of the direct-current motor M. Its cut-off frequency is higher than that of the second low-pass filter R4/C2. The band-pass characteristic of the filter circuit results from connecting the one low-pass filter to the inverting input and the other to the non-inverting input of the operational amplifier A. The resistor R6 of the voltage divider sets an amplitude threshold value for the measuring signal so that only signals of a specific minimum magnitude are filtered and evaluated.

In another embodiment of the circuit arrangement of the present invention, the filter circuit is integrated in the microcontroller.

A capacitor may be connected between the inputs of the operational amplifier A to suppress high-frequency interference signals.

What is claimed is:

1. A method of determining the quantity of the material cut by an electrically powered cutting tool having a drive mechanism, comprising cutting said material, determining the fluctuations of the current consumed by the drive mechanism of the cutting tool during said cutting, and evaluating said fluctuations to determine the quantity of material cut.

2. The method as claimed in claim 1, wherein said evaluating includes converting the current fluctuations into voltage fluctuations.

3. The method as claimed in claim 1, wherein said evaluating includes filtering out the fluctuations detected whose frequencies are outside a specific frequency range, and wherein said fluctuations are pulses, so that only pulses that are characteristic of the cutting operation are evaluated.

4. The method as claimed in claim 3, wherein the evaluation of pulses includes performing a count of the number of pulses.

5. The method as claimed in claim 3, wherein the evaluation of pulses includes performing a total of the length of the pulses.

6. The method as claimed in claim 3, wherein the evaluation of pulses includes performing an integration of the pulses.

7. The method as claimed in claim 1, whereby only such fluctuations whose amplitude exceeds a predetermined threshold value are evaluated.

8. Use of the method according to claim 1 for determining and indicating the degree of soiling of a cutting tool, particularly a haircutting apparatus, further comprising providing an indicating device alerting the user to the need for cleaning, and activating said indicating device when the quantity of the cut material reaches a predetermined threshold value.

9. A circuit arrangement for determining the quantity of the material cut by an electrically powered cutting tool by determining and evaluation the fluctuations of the current consumed by the drive mechanism of the cutting tool during the cutting operation, said circuit including a detecting element for generating a measuring signal for the current consumed by the drive mechanism, a filter device for filtering the measuring signal, and a device for evaluating the fluctuations of the filtered measuring signal to determine a quantity of material cut.

10. The circuit arrangement as claimed in claim 9, wherein the detecting element comprises a resistor.

11. The circuit arrangement as claimed in claim 9, wherein the filter device comprises at least one low-pass filter or a band-pass filter.

12. The circuit arrangement as claimed in claim 11, wherein the band-pass filter includes a first low-pass filter with a first cut-off frequency and a second low-pass filter with a second cut-off frequency as well as an operational amplifier, and wherein the one low-pass filter is connected to the inverting input while the other low-pass filter is connected to the non-inverting input of the operational amplifier.

13. The circuit arrangement as claimed in claim 9, wherein the device for evaluating the filtered measuring signal comprises a microcontroller.

14. The circuit arrangement as claimed in claim 13, further comprising a device indicating the degree of soiling which is selectable by the microcontroller.

15. The circuit arrangement as claimed in claim 13, further comprising a device for resetting the soiling indication which is connected to the microcontroller.

16. The circuit arrangement as claimed in claim 9, further comprising a device for setting a threshold value for the measuring signal.

* * * * *